US006095142A

United States Patent [19]

Giorgini

[11] Patent Number: 6,095,142

[45] Date of Patent: Aug. 1, 2000

[54] PROGRESSIVE PRESSURE INDICATOR

[75] Inventor: Eugene Giorgini, Cheektowaga, N.Y.

[73] Assignee: Scott Technologies, Inc., Cleveland, Ohio

[21] Appl. No.: 09/104,665

[22] Filed: Jun. 25, 1998

[51] Int. Cl.[7] ..... A62B 7/00

[52] U.S. Cl. ..... 128/205.23; 128/202.22

[58] Field of Search ..... 128/205.23, 202.22, 128/201.27, 204.26

[56] References Cited

U.S. PATENT DOCUMENTS

| | | | |
|---|---|---|---|
| 3,914,736 | 10/1975 | Nakamura et al. | 340/52 C |
| 4,800,373 | 1/1989 | Mayz | 340/626 |
| 5,097,826 | 3/1992 | Gray et al. | 128/204.18 |
| 5,191,317 | 3/1993 | Toth et al. | 128/205.23 |
| 5,351,188 | 9/1994 | Sato | 128/202.22 |
| 5,357,242 | 10/1994 | Morgano et al. | 340/626 |
| 5,457,284 | 10/1995 | Ferguson | 128/202.22 |
| 5,506,571 | 4/1996 | Dugan | 128/202.22 |

*Primary Examiner*—Aaron J. Lewis
*Assistant Examiner*—Teena Mitchell
*Attorney, Agent, or Firm*—Ralph E. Jocke; Daniel D. Wasil

[57] ABSTRACT

A pressure indicating device for self contained breathing apparatus includes a piston arrangement which is responsive to the relative pressures of the supply and the pressure at the outlet of the first stage regulator to assume several different positions in the containment housing. Piston position is recognized by electronic circuitry and an LED display is lighted accordingly to provide a series of unique signals to the user, of the remaining quantity of breathing fluid. In one embodiment of the invention, plural, graduated-size pistons provide a progressive indication of the air supply. In another embodiment, a single, stepped piston effects progressive electrical contact at various positions in the travel of the piston.

20 Claims, 4 Drawing Sheets

PROGRESSIVE PRESSURE INDICATOR

TECHNICAL FIELD

This invention relates to a self contained breathing apparatus and more particularly to a self contained breathing apparatus that provides an indication to a user that a supply of air is approaching depletion.

BACKGROUND ART

Self contained breathing apparatus is well known in the art and is used in many environments by fire fighters, haz-mat persons and the like who might be exposed to noxious atmospheres. Such breathing apparatus generally includes a supply of pressurized air originally at a relatively high pressure, and regulator devices to reduce the pressurized air to a lower level. The air at the lower pressure is made available to a user, often in a face mask or hood or similar device. The regulator devices may be fairly complex in some instances in having first and second stage regulators. Such regulator devices may deliver air in response to a user's inhalation. Also, such regulator devices may maintain a pressure higher than ambient pressure in the user's face mask or hood so as to prevent entry of noxious gases into the breathing system. All such systems, however, are subject to the common occurrence that being self contained, the supply of air will eventually be depleted and it is advantageous to provide a signal to the user of this impending situation.

Many forms of apparatus have been devised to provide such a signal to the user. Prior arrangements have included vibrating alarm devices, whistles, visual indicators and the like which are operative upon a change in fluid pressure within the regulator system to signal the user of a certain condition of the system related to a relatively low supply of pressurized breathing air.

Examples of such a system are shown in prior patent, U.S. Pat. No. 3,957,044 and in co-pending application, International Application No. PCT/US98/06158. In both of these systems a first stage regulator is used to supply air to a second stage regulator, the latter mounted on a user's face mask, for example. The first stage regulator supplies air at a first pressure level until the pressure level of the air supply drops to a lower level, indicating an approach to depletion of the air supply. This condition is recognized in the regulator system, in one instance by use of dual first regulator valves and in the other by use of a transfer valve which modifies the action of the first regulator valve. In both systems the outlet of the first regulator valve is raised to a second higher pressure for application to the second regulator valve.

This second higher pressure is recognized in these systems in a sensing chamber which includes a moveable piston which is exposed to the outlet of the first regulator valve. The pressure on the piston acts against a spring bias to close electrical contacts as the bias is overcome. A signal lamp such as an LED may be lighted or alternative signals employed, such as whistles, sirens, on/off indicators and the like. In these systems however, only a single level of air supply pressure is utilized to initiate the alarm signal, typically being when the air pressure level has dropped to about one-fourth of its initial pressure level. While this is a tried and proven technique for signaling, there is still some variability in the timing of the remaining air supply which is dependent upon several factors, including among others, the integrity of the entire air supply system, the form of mask or hood being used, and the physical breathing rates or volumes of the user. Thus, the availability of breathing air to the user is variable in time and it is the available time which is important in the decision-making process of the user.

This factor has been recognized in the past and solutions have been indicated. Thus, in my co-pending application, previously referenced, a clock device or timer is indicated which is triggered upon sensing the higher pressure level applied to the second stage regulator. The timer can then provide signals at a periodic interval or can change the flash rate of LEDs or the like, based upon a pre-assumed time out. However, such a system still does not accommodate the actual conditions occurring in the regulator system which are variable among users, the system parameters, the environment and the like as previously described.

Thus, there is a need for a self contained breathing apparatus that provides a user with an indication of impending depletion of the air supply, which provides plural indications and which is more accurate than prior systems.

DISCLOSURE OF INVENTION

It is an object of the present invention to provide a self contained breathing apparatus.

It is a further object of the present invention to provide a pressure indicator for use in conjunction with a self contained breathing apparatus.

It is a further object of the present invention to provide a self contained breathing apparatus that provides a user with multiple indications of the impending depletion of the air supply.

It is a further object of the present invention to provide a self contained breathing apparatus that is more accurate in providing indications of the time, the pressure or both the time and pressure of remaining air supply.

Further objects of the present invention will be made apparent in the following Best Modes for Carrying Out Invention and the appended claims.

The foregoing objects are accomplished in a preferred embodiment of the present invention by a self contained breathing apparatus that includes a pressure vessel containing a supply of breathing air. The breathing air from the pressure vessel is communicated to a first stage pressure regulator which is initially set at a nominal first pressure value. The pressure from the pressure vessel is also communicated to a step up valve. The first stage regulator delivers air at the first pressure to a second stage breathing regulator mounted on a face mask worn by a user. Air is then supplied to the face mask through the breathing regulator in response to a user's breathing efforts.

When the pressure in the pressure vessel is above a level indicative of impending depletion, a transfer piston in the step up valve is biased by the pressure from the pressure vessel to a closed position. When the pressure in the pressure vessel falls to a level indicative of impending depletion, the pressure acting on the transfer piston in the step up valve is reduced to a level which causes the transfer piston to shift to a second position. Movement of the transfer piston causes pressure from the first stage regulator to be delivered to a charging passage. Delivery of increased pressure to the charging passage moves a step up piston which acts to change the pressure setting of the first stage regulator to a higher pressure. This increased pressure is communicated to the second stage breathing regulator.

The sensor portion of the pressure indicator includes a progressive piston assembly slidable in a housing and exposed to the opposing pressures of the air supply and the output of the first stage regulator. In one embodiment of the invention the piston assembly consists of a plurality of pistons of various diameters individually slidable in the housing between upper and lower positions. Each piston includes a lower stepped down diameter portion, slidable in stepped down bores, all of equal diameter and exposed to the air supply pressure. The various diameter upper piston portions are exposed to the output of the first stage regulator. All of the pistons in the piston assembly thus are initially biased to the upper position by the high pressure supply air, but are biased in turn, to the lowermost positions as the air supply pressure falls, under the influence of the output of the first stage regulator.

A sensor brush is associated with each piston of the assembly and is contacted by the respective piston in its uppermost position to complete an electrical circuit, causing the lighting of a respective LED of other alarm in a signal device assembly. The signal device may be positioned closely adjacent the face mask of the user so that the signals are readily observable. In this arrangement all of the LEDs in the signal device are illuminated under a high pressure initial condition of the air pressure supply and are extinguished in stages as the air supply pressure drops. By sizing the pistons appropriately, the largest piston could be caused to move to the lowermost position when the air pressure at the first stage regulator is raised to a second higher level, extinguishing the first LED in the signal device.

The smaller sized pistons are subsequently moved to their respective lower positions as air supply pressure continues to fall until all pistons have reached the bottom positions. By appropriate sizing of the pistons, a progressive indication is provided to the user, the timing of which is dependent upon the rate of fall of air supply pressure. Such an indication can provide a much more refined estimate to the user of the quantity of air remaining in the air supply.

A second embodiment of the invention consists of a single, stepped piston assembly mounted in a housing and having a lower smaller bore exposed to air supply pressure. A coil spring is included in the smaller bore. The spring acts upon the piston in concert with air supply pressure and moves the piston to various positions in its travel as the air supply pressure diminishes. The upper portion of the piston is exposed to first stage regulator outlet pressure and consists of a stepped diameter piston, with the largest diameter piston section being uppermost in an upper bore of a housing. A plurality of sensor brushes are mounted in the housing for contact with respective piston sections as the piston assembly moves in response to declining supply pressures. The sensor brushes are mounted at increasing distances, from top to bottom, from the respective contacting piston sections to provide a progressive closing of electrical contact for a plurality of LEDs, one LED corresponding to each sensor brush, in a remote signal device. In this arrangement the LEDs are initially extinguished under high air supply pressure, but become energized as the piston moves downward in accordance with falling air supply pressure.

A third embodiment of the invention consists of a single, stepped piston assembly mounted in a housing and having a lower smaller bore exposed to air supply pressure. A coil spring is included in the larger upper bore. The spring biases the piston against the air supply pressure and moves the piston to various positions in its travel as the air supply pressure diminishes. The upper portion of the piston consists of a stepped diameter piston, with the largest diameter piston section being uppermost in an upper bore of a housing. A plurality of sensor brushes are mounted in the housing for contact with respective piston sections as the piston assembly moves in response to declining supply pressures. The sensor brushes are mounted at increasing distances, from top to bottom, from the respective contacting piston sections to provide a progressive closing of electrical contact for a plurality of LEDs, one LED corresponding to each sensor brush, in a remote signal device. In this arrangement the LEDs are initially extinguished under high air supply pressure, but become energized as the piston moves downward in accordance with falling air supply pressure.

BEST MODES FOR CARRYING OUT INVENTION

Figure 1:
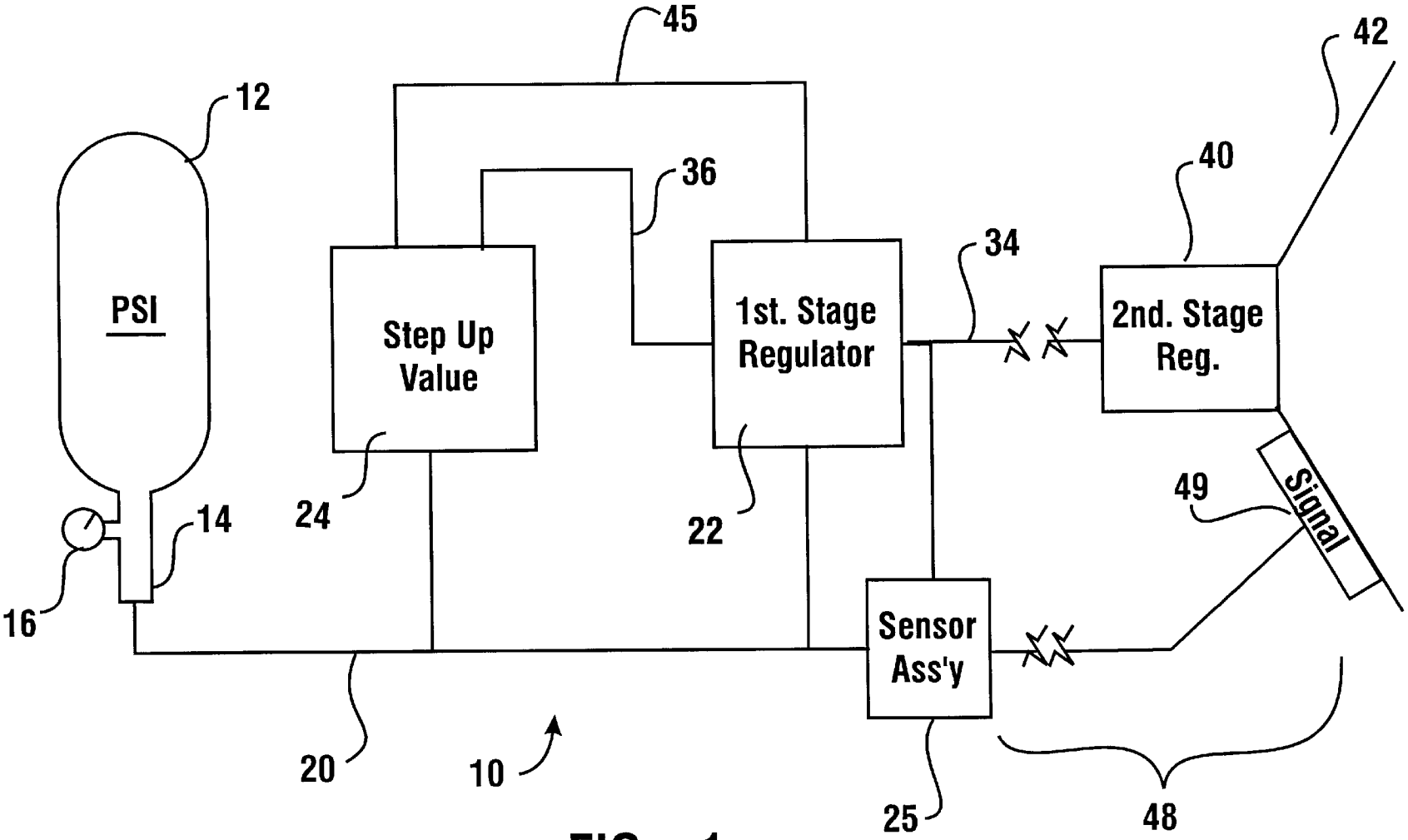
FIG. 1 is a schematic diagram of a self contained breathing apparatus of a first preferred embodiment of this invention which is used to deliver air to the user.

Referring now to the drawings and particularly FIG. 1, there is shown therein a preferred embodiment of self contained breathing apparatus of the present invention generally indicated 10. The apparatus includes a pressure vessel 12 or other source which provides a source of breathing air. The pressure vessel includes a conventional outlet 14 and a pressure gauge 16 and is coupled to a supply conduit 20. Supply conduit 20 is in fluid communication with a first stage pressure regulator 22, a step up valve 24 and a sensor assembly 25.

First stage regulator 22 in the embodiment shown is a single stage regulator. It includes a diaphragm which is operated upon by fluid pressure in a chamber therein derived from a metering element, also therein and positioned at the inlet from supply conduit 20. The diaphragm is acted upon by a bias spring, the force of which acts in a direction opposite to the force applied to the diaphragm by the regulator pressure. The output pressure of regulator 22 appears both at conduit 34 and at transfer passage 36 which leads back to step up valve 24. Preferably, the bias spring in regulator 22 is set so that the fluid pressure maintained in the chamber therein and thus in conduits 34, 36 is generally about 100 PSIG. Supply pressure in vessel 12 may be of the type that initially holds air at a pressure of about 4500 PSIG.

Details of most of a system such as this are described in my prior patent or co-pending application, however, the description provided herein is sufficient for an understanding of this invention.

Outlet 34 of regulator 22 is in fluid communication, by way of a flexible hose or the like, with a second stage or breathing regulator 40 for supplying air to a user. Breathing regulator 40 is in operative connection with a face mask 42 which is preferably placed in fluid tight relation with the user's mouth and nose.

Breathing regulator 40 may be any one of a number of conventional or novel types including demand regulators or positive pressure type regulators. It should be understood that the present invention is in no way limited to a particular type of regulator for supplying air to a user.

In FIG. 1 a pilot actuated demand type regulator may be employed. This type of regulator includes a moveable sensing diaphragm which moves in response to pressure that is applied as a result of a user's breathing efforts. The diaphragm acts to move a lever to open a pilot, causing the opening of a main valve to permit flow of air from conduit 34 to a delivery passage located in the interior of mask 42.

Breathing regulator 40 may include or be connected to additional devices, not shown, but which may include a positive pressure mechanism for face mask 42. Breathing regulator 40 may also be connected to warning devices such as a valve or whistle combination or vibration device responsive to the pressure in conduit 34 exceeding a predetermined level. In one form of the invention, these devices are set to provide an alarm when pressure in conduit 34 exceeds 130 PSIG.

Step up valve 24 is a complex valve or valve arrangement which includes a transfer piston and other devices therein. Its primary function, however, is to sense when pressure in air supply conduit 20 drops below a predetermined level (approximately one-fourth of the initial pressure of pressure vessel 12) to increase the pressure in charging passage 45 leading to first stage regulator 22. Such increase in pressure in charging passage 45 increases the bias acting on the diaphragm in regulator 22 causing the regulated pressure in conduits 34 and 36 to rise to a second, higher predetermined level. In this embodiment of the invention such second, higher pressure level at the output of regulator 22 is approximately 150 PSIG.

Conduit 34 is also in connection with sensor assembly 25 forming a part of progressive pressure indicator assembly 48 and which also includes signal assembly 49, the latter being placed as a part of or closely adjacent a transparent part of face mask 42.

Figure 2:
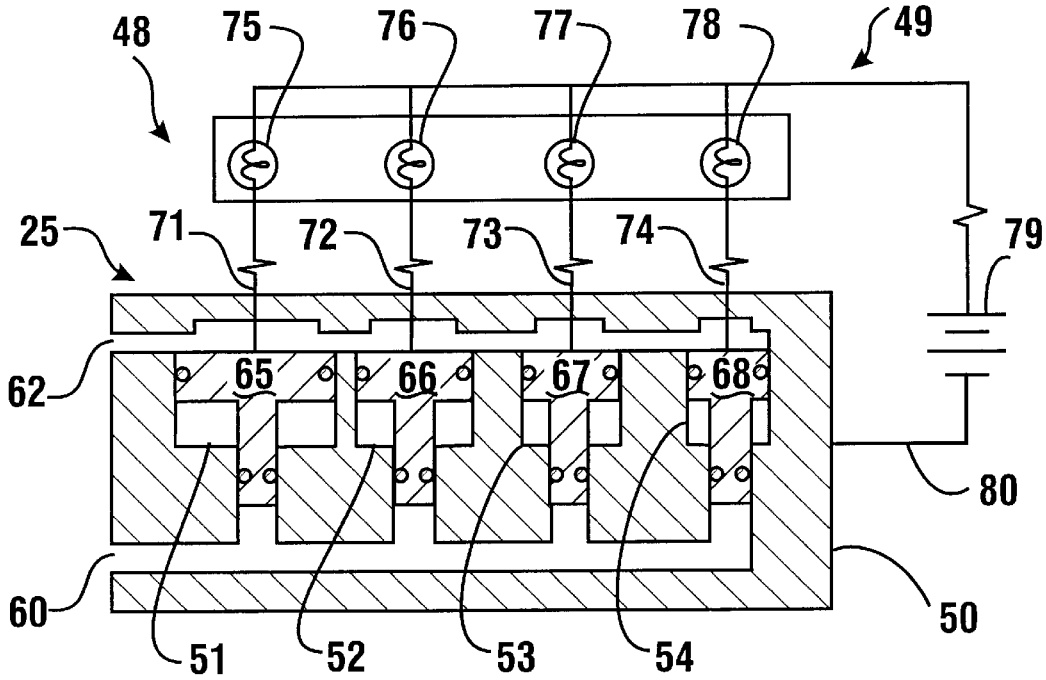
FIG. 2 is a schematic diagram of a first embodiment of progressive pressure indicator of the invention, showing the sensor assembly portion of FIG. 1 in a cross sectional view.

One embodiment of progressive pressure indicator assembly 48 is shown in schematic form in FIG. 2 wherein sensor assembly 25 consists of cylinder housing 50 having four vertical bores 51–54 therein. A lower chamber 60 receives air pressure supply from conduit 20 and is in fluid communication with the lower ends of bores 51–54. An upper chamber 62 receives air from first stage regulator 22 by way of conduit 34 and is in fluid communication with the upper ends of bores 51–54. Bores 51–54 each have an upper portion and a lower portion. The upper portions are graduated in size, decreasing in diameter from upper portion of bore 51 to upper portion of bore 54. All bores are stepped and have respective lower bore portions of substantially the same diameter and which communicate directly with lower chamber 60.

Stepped pistons 65–68 are fitted in stepped bores 51–54, each having a large upper piston portion and a smaller lower piston portion. All of the pistons are fitted with seals to allow sliding movement in bores 51–54 from an upper position as shown in FIG. 1 to a lower position. Pistons 65–68 are graduated in size at the upper piston portion from large piston 65 to smaller piston 68, while lower piston portions of all pistons 65–68 are of substantially the same diameter.

Each piston 65–68 has associated with it an electrical contact brush 71–74 which is sealingly and insulatively supported in cylinder housing 50 and which protrudes into upper chamber 62 so as to be contacted by respective piston 65–68 when the latter is in its uppermost position as shown in FIG. 1. Brushes 71–74 serve as detectors and are connected by conductive wires to respective LEDs 75–78 forming the indicator device for signal assembly 49. Each LED 75–78 is connected at the common side to a battery 79 or other electrical source, the circuit being completed by wire 80 in contact with conductive housing 50 and conductive pistons 65–68.

As noted previously, pressure in upper chamber 62 is normally at about 100 PSIG and reaches about 150 PSIG when step up valve 24 recognizes a lowering of pressure in air supply conduit 20. The pressure in lower chamber 60 may initially be at a very high pressure on the order of 4500 PSIG, but which falls upon depletion of the air supply in vessel 12. By selective sizing of the stepped pistons 65–68, various pressure levels may be determined at which the respective piston will be moved from its upper position to a lower position. As each piston moves out of contact with its respective brush 71–74, respective LED 75–78 are extinguished and provide an indication to the user not only of the reduction in air supply, but also the rate of change of the air supply so that he can better estimate the remaining time of availability of breathing air.

It should be understood that four bores with associated pistons, sensor brushes and LEDs have been shown in this embodiment, but that two, three or five or more may be used depending on the number and types of indications desired.

Figure 3:
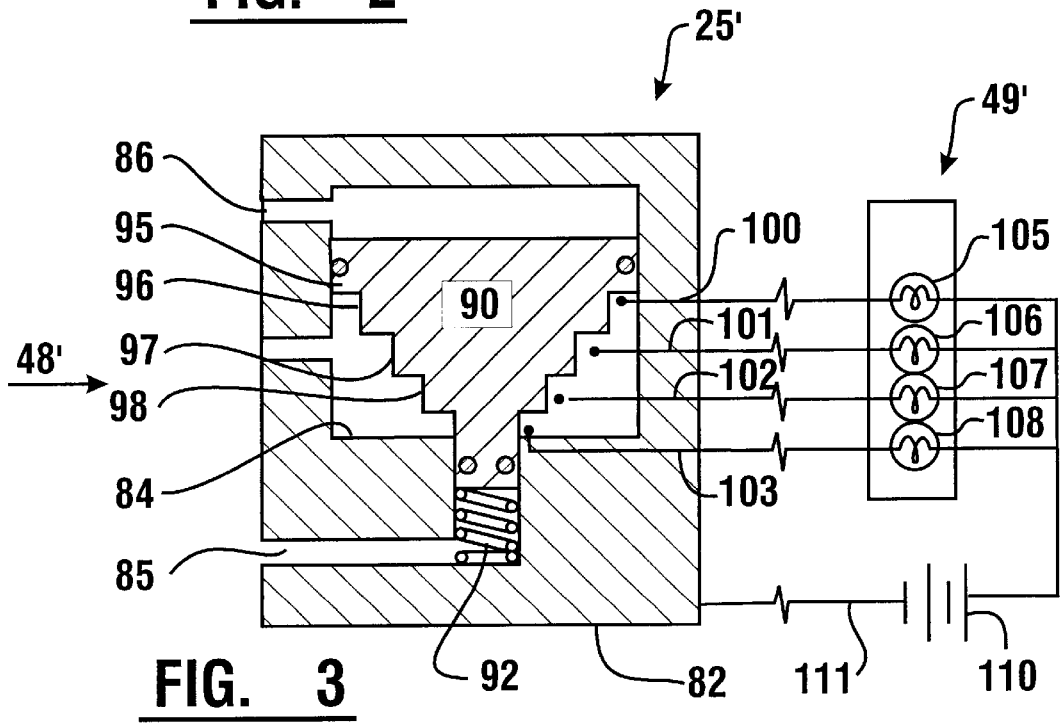
FIG. 3 is a schematic diagram of a second embodiment of progressive pressure indicator of the invention, showing the sensor assembly portion in a cross sectional view.

Another embodiment includes a progressive pressure indicator assembly 48' shown in FIG. 3. Assembly 48' includes a sensor assembly 25' and a signal assembly 49'. Sensor assembly 25' consists of cylinder housing 82 having bore 84 therein communicating respectively with lower chamber 85 and upper chamber 86. Chamber 85 receives air supply pressure from air supply conduit 20 and chamber 86 receives pressure from first stage regulator 22 by way of conduit 34. Bore 84 is stepped, having a large diameter upper portion and a small diameter lower portion. Stepped piston 90 is slidably movable in the bore. Stepped piston 90 has a correspondingly sized upper and lower portion, both of which carry an appropriate seal. The lower portion of bore 84 is shown receiving a compression spring 92. Spring 92 acts upon the lower portion of piston 90 to urge the latter upwardly, although spring 92 may not be required in some embodiments.

Piston 90 as shown in FIG. 3 includes graduated steps 95–98 thereon of varying diameter extending from an upper step 95 sized to fit in the upper portion of bore 84, to a smaller step 98 slightly larger than the lower portion of piston 90. Four sensor brushes 100–103 are insulatively fitted in housing 82. The sensor brushes extend into bore 84 to respective positions in the path of movement of steps 95–98 as piston 90 moves from the uppermost position toward a lowermost position in which step 98 is in contact with the stepped portion of bore 84. Each sensor brush 101–103 is spaced differently from its respective step 95–98 so that initial contact will be made with brush 100 by step 95, then in descending order, until contact is made between brush 103 and step 98 when piston 90 is in its downwardmost position.

Signal assembly 49' consists of four remote LEDs 105–108 associated with face mask 42, interconnected by conductive wire with respective brushes 100–103. The common side of LEDs 105–108 are connected to a battery 110, while the ground side of battery 110 is connected by wire 111 to conductive housing 82 for completion of the electrical circuit.

In this embodiment, as air supply pressure falls in lower chamber 85, air pressure in upper chamber 86 acts upon piston 90 to urge it against the bias of spring 92 downward as shown. Electrical engagement with contact brushes 100–103 will be made serially during downward movements of piston 90, until all LEDs 105–108 are illuminated. Again, not only will a reduction in pressure in air supply vessel 12 be sensed by illumination of first LED 105, but also a rate of change of the air supply can be sensed by the timing of the illumination of the subsequent LEDs 106–108, so that the user can more accurately estimate the remaining timing for delivery of air.

It should be understood that two, three or five or more graduated steps, contact brushes and LEDs may be used depending on the degree of sensitivity required.

As indicated previously, signals or indicators other than LED illumination can be utilized in lieu of or in conjunction with the LEDs 75–78 and 105–108 described. Similarly other devices could be employed to detect or sense piston position rather than contact brushes 71–74 and 100–103. These might include magnetic sensor devices, photocell or any other from of contact or non-contact position sensing device.

Figure 4:
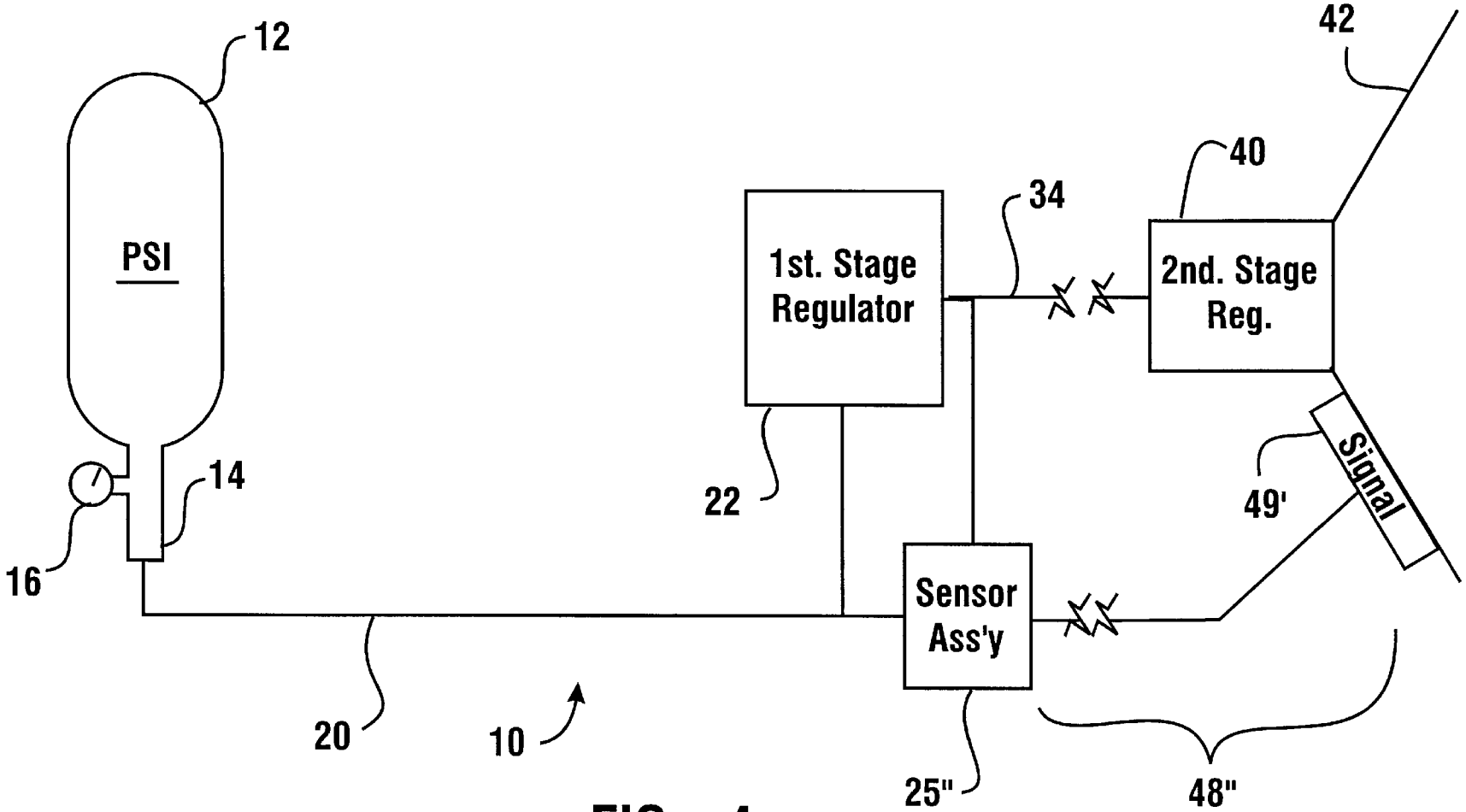
FIG. 4 is a schematic diagram of a self contained breathing apparatus of a second preferred embodiment of this invention which is used to deliver air to the user.

FIG. 4 shows a second preferred embodiment of a self contained breathing apparatus of the present invention which is similar to the embodiment shown in FIG. 1 except as otherwise indicated. This embodiment includes a progressive pressure indicator assembly 48' shown in FIG. 5. Assembly 48" includes a sensor assembly 25" and a signal assembly 49'. Sensor assembly 25" is in connection with system pressure vessel 12 through supply conduit 20 but is not in connection with first stage pressure regulator 22.

In this embodiment sensor assembly 25" consists of cylinder housing 112 having bore 114 therein communicating with a lower chamber 115. Chamber 115 receives air supply pressure from air supply conduit 20. Bore 114 is stepped, having a large diameter upper portion and a small diameter lower portion. Stepped piston 120 is slidably movable in the bore. Stepped piston 120 has a correspondingly sized upper and lower portion, both of which carry an appropriate seal. The upper portion of piston 120 is also acted upon by a compression spring 122. The spring 122 acts upon the upper portion of piston 120 to urge the latter downwardly. The large diameter upper portion of the bore is vented to atmosphere through vents 123, 124 so that the piston may readily move in response to changes in pressure in chamber 115.

Figure 5:
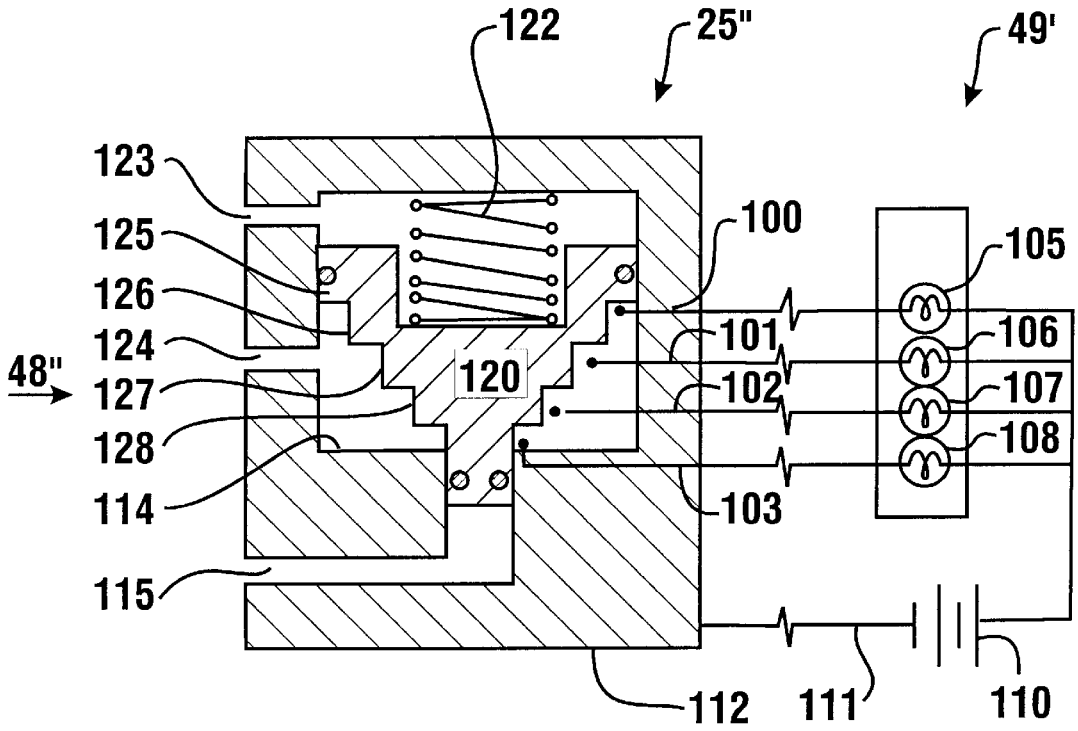
FIG. 5 is a schematic diagram of an embodiment of progressive pressure indicator of the invention, showing the sensor assembly portion of FIG. 4 in a cross sectional view.

Piston 120 as shown in FIG. 5 includes graduated steps 125–128 thereon of varying diameter extending from an upper step 125 sized to fit in the upper portion of bore 114, to a smaller step 128 slightly larger than the lower portion of piston 120. Four sensor brushes 100–103 are insulatively fitted in housing 112. The sensor brushes extend into bore 114 to respective positions in the path of movement of steps 125–128 as piston 120 moves from the upwardmost position toward a lowermost position in which step 128 is in contact with the stepped portion of bore 114. Each sensor brush 101–103 is spaced differently from its respective step 125–128 so that initial contact will be made with brush 100 by step 125, then in descending order, until contact is made between brush 103 and step 128 when piston 120 is in its downwardmost position.

As described above signal assembly 49' consists of four remote LEDs 105–108 associated with face mask 42, interconnected by conductive wire with respective brushes 100–103. The common side of LEDs 105–108 are connected to a battery 110, while the ground side of battery 110 is connected by wire 111 to conductive housing 112 for completion of the electrical circuit.

In this embodiment, as air supply pressure falls in lower chamber 115, air pressure in spring 122 acts upon piston 120 to urge it downward as shown. Electrical engagement with contact brushes 100–103 will be made serially during downward movements of piston 120, until all LEDs 105–108 are illuminated. Again, not only will a reduction in pressure in air supply vessel 12 be sensed by illumination of first LED 105, but also a rate of change of the air supply can be sensed by the timing of the illumination of the subsequent LEDs 106–108, so that the user can more accurately estimate the remaining timing for delivery of air.

As indicated previously, signals or indicators other than LED illumination can be utilized in lieu of or in conjunction with the LEDs 75–78 and 105–108 described. Similarly other devices could be employed to sense piston position rather than contact brushes 71–74 and 100–103. These might include magnetic sensor devices, photocell or any other form of contacting or non-contacting position sensing device.

As can be appreciated from the foregoing description in alternative embodiments a plurality of pistons of various diameters each associated with a signal or indicator may be in connection with system vessel 12 through supply conduit 20. The upper portion of each piston receives a compression spring acting to urge the piston downward. As the air supply falls, the pistons move downward serially and make electrical contact with contact brushes until a signal or indicator is actuated. A reduction in air supply pressure and a rate of change can be sensed by the timing of the actuation of subsequent indicators.

Thus the new self contained breathing apparatus of the present invention achieves the above stated objectives, eliminates difficulties encountered in the use of prior devices and systems, solves problems and attains the desirable results described herein.

In the foregoing description certain terms have been used for brevity, clarity and understanding. However no unnecessary limitations are to be implied therefrom because such terms are for descriptive purposes and are intended to be broadly construed. Moreover the descriptions and illustrations herein are by way of examples and the invention is not limited to the exact details shown and described.

Further, in the following claims any feature that is described as a means for performing a function shall be construed as encompassing any means known in the art which is capable of performing the recited function and shall not be deemed limited to the particular means shown in the foregoing description performing the function, or mere equivalents thereof.

Having described the features, discoveries and principles of the invention, the manner in which it is constructed and utilized, and the advantages and useful results attained; the new and useful structures, devices, elements, arrangements, parts, combinations, systems, equipment, operations, methods and relationships are set forth in the appended claims.

I claim:

1. Fluid pressure level indicator apparatus, comprising:

a housing having first and second inlet openings and first and second pressure passages therein, wherein the first passage is in fluid communication with the first inlet opening, wherein the second passage is in fluid communication with the second inlet opening, a progressive pressure responsive device supported in said housing and in fluid communication with said first and second pressure passages, wherein said progressive pressure responsive device is movable to different discrete positions in response to the relative pressure levels in said passages, a position sensor device, wherein the positive sensor device is operative to detect movement of said progressive pressure responsive device to said different discrete positions, signal apparatus responsive to said position sensor device, wherein the signal apparatus is operative to provide unique signals indicative of said different discrete positions occupied by said progressive pressure responsive device, and a breathing apparatus for supplying breathing air to a user from a pressurized air supply source, said air supply being connected to said second passage for movement of said progressive pressure responsive device responsive to pressure of said air supply source.

2. The apparatus according to claim 1 wherein said progressive pressure responsive device, comprises:

a progressive piston assembly supported in said housing for slidable movement between first and second positions.

3. The apparatus according to claim 1 wherein said breathing apparatus is self contained and includes a first stage regulator for reducing air pressure from said source to a lower level suitable for the user, and said first passage is connected to the output of said first stage regulator.

4. Fluid pressure level indicator apparatus, comprising:

a housing having first and second pressure passages therein, a progressive pressure responsive device supported in said housing and in fluid communication with said first and second pressure passages, wherein said progressive pressure responsive device is movable to different discrete positions in response to the relative pressure levels in said passages, wherein the progressive pressure responsive device comprises a progressive piston assembly supported in said housing for slidable movement between first and second positions, wherein said progressive piston assembly comprises plural pistons having first and second portions exposed respectively to said first and second pressure passages, said first and second portions being sized to be responsive to different relative pressure levels at said first and second passages to cause movement of said respective piston from one discrete position to another, a position sensor device, wherein the sensor device is operative to detect movement of said progressive pressure responsive device to said different discrete positions, signal apparatus responsive to said position sensor device, wherein the signal apparatus is operative to provide unique signals indicative of said different discrete positions occupied by said progressive pressure responsive device, and a breathing apparatus for supplying breathing air to a user from a pressurized air supply source said air supply being connected to said second passage for movement of said progressive pressure responsive device responsive to pressure of said air supply source.

5. The apparatus according to claim 4 wherein said first portions of said plural pistons are sized progressively smaller and said second portions are sized substantially equally so that said pistons exhibit progressive movement from a first end of said housing toward a second end as pressure of the air supply source diminishes.

6. Fluid pressure level indicator apparatus, comprising:

a housing having first and second pressure passages therein, a progressive pressure responsive device supported in said housing and in fluid communication with said first and second pressure passages, wherein said progressive pressure responsive device is movable to different discrete positions in response to the relative pressure levels in said passages, wherein the progressive pressure responsive device comprises a progressive piston assembly supported in said housing for slidable movement between first and second positions, wherein said progressive piston assembly comprises a piston slidably supported in said housing for movement between first and second positions, said piston having a step therein providing a larger first portion exposed to air pressure in said first passage and a smaller second portion exposed to air pressure in said second passage, and further including a spring in said housing biasing said piston, a position sensor device, wherein the sensor device is operative to detect movement of said progressive pressure responsive device to said different discrete positions, signal apparatus responsive to said position sensor device wherein the signal apparatus is operative to provide unique signals indicative of said different positions occupied by said progressive pressure responsive device, and a breathing apparatus for supplying breathing air to a user from a pressurized air supply source, said air supply being connected to said second passage for movement of said progressive pressure responsive device responsive to pressure of said air supply source.

7. The apparatus according to claim 6 wherein said position sensor device comprises plural detector elements for sensing plural unique positions of said piston between the first and second position.

8. The apparatus according to claim 7 wherein said plural detector elements are electrical contact brushes between the first and second positions of said piston and adapted for physical engagement with said piston to establish electrical circuits for energizing said signal apparatus.

9. The apparatus according to claim 6 wherein said progressive piston assembly comprises a single piston.

10. Fluid pressure level indicator apparatus, comprising:

a housing having a pressure passage therein, a progressive pressure responsive device supported in said housing and in fluid communication with said pressure passage, wherein said responsive device is movable to different discrete positions in response to the relative pressure level in said passage, a position sensor device, wherein the sensor device is operative to detect movement of said pressure responsive device to said different positions, signal apparatus responsive to said position sensor device, wherein the signal apparatus is operative to provide unique signals indicative of said different positions occupied by said progressive pressure responsive device, and wherein said progressive pressure responsive device comprises a progressive piston assembly supported in said housing for slidable movement between upper and lower positions, wherein said progressive piston assembly comprises a single piston slidably supported in said housing for movement between first and second positions, said single piston having a step therein providing a larger first portion and a smaller second portion, said second portion exposed to air pressure in said passage, and further including a spring in said housing biasing said piston toward the second position, and wherein said position sensor device comprises plural detector elements for sensing plural unique positions of said piston between the first and second positions.

11. The apparatus according to claim 10 wherein said plural detector elements are electrical contact brushes between the first and second positions of said piston and adapted for physical engagement with said piston to establish electrical circuits for energizing said signal apparatus.

12. The apparatus according to claim 10 further comprising breathing apparatus for supplying breathing air to a user from a pressurized air supply source, said air supply being connected to said passage for movement of said progressive pressure responsive device responsive to pressure of said air supply source.

13. The apparatus according to claim 12 wherein said breathing apparatus is self contained and includes a first stage regulator for reducing air pressure from said source to a lower level suitable for the user.

14. Apparatus comprising:

a source of breathable air, a first stage regulator, a second stage regulator, wherein the first stage regulator is positioned fluidly intermediate the source of breathable air and the second stage regulator, wherein the first stage regulator is in fluid communication with the source of breathable air and the second stage regulator;

a fluid line providing fluid communication between the first stage regulator and the source of breathable air, a progressive pressure responsive device, wherein the pressure responsive device includes a movable pressure responsive member and plural elements therein for detecting various unique positions of the movable pressure responsive member, said movable pressure responsive member being responsive to air pressure from said source of breathable air to assume said various unique positions as the air pressure from said source of breathable air diminishes; wherein the progressive pressure responsive device is in fluid communication with the fluid line intermediate the first stage regulator and the source of breathable air, and signal apparatus energized by said movable pressure responsive member to provide unique signals at each of said unique positions in order to warn a user of impending depletion of the air supply.

15. The apparatus according to claim 14 wherein said signal apparatus comprises plural indicators and said indicators are energized in unique patterns for recognition by the user.

16. The apparatus according to claim 15 wherein said plural indicators are light emitting diodes and are illuminated in unique patterns to provide visual signals to the user.

17. The apparatus according to claim 15 wherein the indicators provide an indication of the rate of change of the source of breathable air.

18. The apparatus according to claim 14 wherein the progressive pressure responsive device is positioned fluidly intermediate the source of breathable air and the second stage regulator.

19. A breathing apparatus, comprising:

a pressurized breathable air supply source, an air pressure level indicator apparatus including a housing having first and second inlet openings and first and second pressure passages therein, wherein the first passage is in fluid communication with the first inlet opening, wherein the second passage is in fluid communication with the second inlet opening, the pressurized breathable air supply source being fluidly connected to a passage, a progressive pressure responsive device supported in the housing and in fluid communication with the first and second air pressure passages, wherein the progressive pressure responsive device is movable to different discrete positions in response to the relative air pressure levels in the first and second air pressure passages, a position sensor device, wherein the sensor device is operative to detect movement of the progressive pressure responsive device to the different discrete positions, signal apparatus responsive to the position sensor device, wherein the signal apparatus is operative to provide signals indicative of the different discrete positions of the progressive pressure responsive device, and wherein the progressive pressure responsive device is movably responsive to air pressure of the pressurized breathable air supply source.

20. A breathing apparatus, comprising:

a pressurized breathable air supply source, an air pressure level indicator apparatus including a housing having an air pressure passage therein, the pressurized breathable air supply source being fluidly connected to the passage, a progressive pressure responsive device including a single piston slidably supported in the housing, wherein the piston is movable between first and second positions, and wherein the piston has a step therein providing a larger first portion and a smaller second portion, the second portion exposed to air pressure in the passage, a spring in the housing biasing the piston toward the second position, wherein the piston is movable to different discrete positions in response to the relative pressure level in the passage, a position sensor device including plural detector elements operative to detect different positions of the piston between the first and second positions, signal apparatus responsive to the position sensor device, wherein the signal apparatus is operative to provide signals indicative of the different positions of the piston, and wherein the piston is movably responsive to air pressure of the pressurized breathable air supply source.

* * * * *